United States Patent [19]

Gehman et al.

[11] Patent Number: 4,734,680

[45] Date of Patent: Mar. 29, 1988

[54] DETECTION SYSTEM WITH RANDOMIZED TRANSMISSIONS

[75] Inventors: Stacy E. Gehman, Lincoln, Nebr.; Kevin T. Ruddell, Seattle, Wash.; Brian D. Dawson, Lincoln, Nebr.

[73] Assignee: Emhart Industries, Inc., Indianapolis, Ind.

[21] Appl. No.: 826,726

[22] Filed: Feb. 6, 1986

[51] Int. Cl.[4] ..... G08B 1/08

[52] U.S. Cl. ..... 340/539; 340/531; 331/64; 331/78; 455/63

[58] Field of Search ..... 340/539, 531, 506, 505; 455/9, 53, 63, 67; 11/11; 364/717; 331/78, 64, 65

[56] References Cited

U.S. PATENT DOCUMENTS

| | | | |
|---|---|---|---|
| 3,492,587 | 1/1970 | Hutton | 340/825.69 |
| 3,689,888 | 9/1972 | Wootton | 340/539 |
| 3,713,142 | 6/1973 | Getchell | 340/505 |
| 3,735,353 | 5/1973 | Donovan et al. | 340/534 |
| 4,101,872 | 7/1978 | Pappas | 340/539 |
| 4,161,041 | 7/1979 | Butler et al. | 364/717 |
| 4,442,426 | 4/1984 | Heuschmann et al. | 340/539 |
| 4,462,022 | 7/1984 | Stolarczyk | 340/539 |
| 4,477,809 | 10/1984 | Bose | 340/825.54 |
| 4,523,184 | 6/1985 | Abel | 340/539 |

*Primary Examiner*—Donnie L. Crosland
*Attorney, Agent, or Firm*—Carl A. Forest

[57] ABSTRACT

A detection system having sending units for sending data signals representative of a condition, such as fire, smoke, intrusion, battery condition, or an emergency, to a central receiving unit. The sending units include a microcomputer which generates a pseudo-random number, waits for a number of cycle periods equal to the pseudo-random number, then activates a transmitter to send a data signal to the receiving unit. The randomized transmission prevents the synchronized clashing of transmitters.

2 Claims, 3 Drawing Figures

DETECTION SYSTEM WITH RANDOMIZED TRANSMISSIONS

BACKGROUND OF THE INVENTION

1. Field of the Invention

The invention in general relates to detection systems and in particular to detection systems having a plurality of detector/sending units for reporting the existence of a condition to a central receiving unit.

2. Description of the Prior Art

Detection systems which include a plurality of remote sending units which transmit coded signals to a central receiving unit which decodes the signals to produce an alarm or other indication of a condition at the remote location are well known. The conditions may be the existence of a fire, an intrusion, an emergency or other condition desired to be monitored. Or the condition may be the status of the sending unit, such as the condition of its battery or other sensor status. Systems in which such conditions are reported at periodic intervals are generally known as supervised systems. Because the sending units act independently, two or more transmissions will occasionally overlap, a situation referred to as collision or clash. When a clash occurs, information from the clashing transmissions is lost at the receiving unit. If clash occurs in a supervised transmission, the sending unit appears to be missing or not functioning for that supervisory cycle. The sending unit is then erroneously reported as missing or not functioning. If the two clashing transmitters have identical or very close reporting cycles, their transmissions may become synchronized, resulting in multiple successive clashes.

Prior art systems have attempted to solve the problem of clash by requiring the transmissions from an individual sending unit to be missing for a time equal to several supervisory cycles and by having loose tolerances on the transmitter electronics. The loose tolerances decreases the probability that two or more transmitters in a system will have supervisory cycles that are close enough to cause multiple successive clashes. However, this approach is effective only when the duration of the transmissions are very short relative to the supervisory period. Further, a detection system must operate continuously for years, and in a large system with, say, thirty or more transmitters installed over a wide area with varying ambient conditions (which can change the cycle periods) the probability is unacceptably high that two or more transmitters will at some time have reporting cycles that are sufficiently close to cause synchronized clashing.

SUMMARY OF THE INVENTION

It is an object of the invention to provide a detection system in which the periods between transmissions of individual sending units are randomized, thus markedly decreasing the probability of synchronized clashing.

The invention provides a detection system comprising a plurality of sending units, each of the units including a sensing means for sensing a condition, a means responsive to the sensing means for sending a data signal representative of the condition at randomized time intervals, and receiving means for receiving the data signals and producing an output indicative of the condition. Preferably the means for sending includes a means for generating a pseudo-random number, and a means for delaying the sending of the data signal for a time period related to the pseudo-random number.

The inventoion also provides a method of providing an indication of a condition at a remote location comprising the steps of sensing the condition, waiting for a randomized time interval, sending a data signal representative of the condition, and receiving the data signal and utilizing it to provide an indication of the condition. Preferably, the step of waiting comprises generating a pseudo-random number and waiting for a time interval related to the pseudo-random number. In the preferred embodiment, the step of waiting for a time interval related to the pseudo-random number comprises cycling through a timing loop for a number of times equal to the pseudo-random number. The method may also include the step of waiting for an additional predetermined time interval.

Numerous other features, objects and advantages of the invention will become apparent from the following detailed description when read in conjunction with the accompanying drawings.

DESCRIPTION OF THE PREFERRED EMBODIMENT

Figure 1:
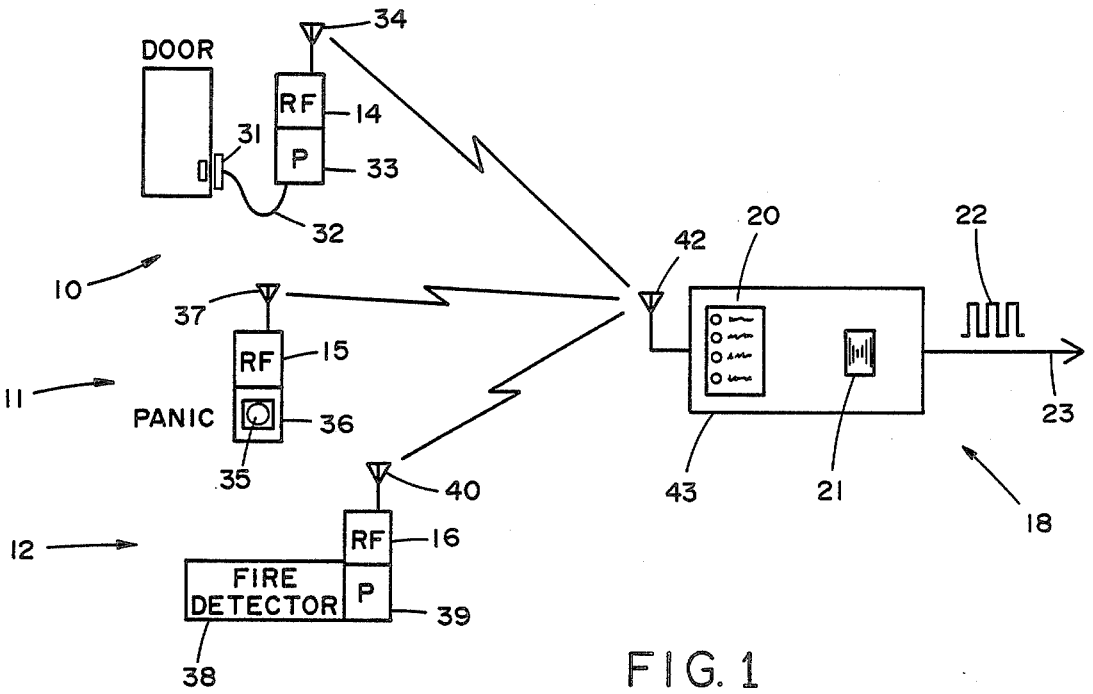
FIG. 1 is a schematic illustration of an exemplary detection system according to the invention.

Directing attention to FIG. 1, an exemplary embodiment of the detection system according to the invention is shown. This embodiment is generally referred to as a security system. The embodiment includes three remote sending units 10, 11 and 12 and a receiving unit 18. The sending units include an intrusion detector 10 on a door, a panic button unit 11, and fire detector unit 12, each of which produces a signal when the particular condition they are designed to detect occurs. Each remote detector unit 10, 11 and 12 has a radio frequency (r-f) transmitter 14, 15 and 16 respectively, associated with it which transmits an r-f signal at randomized time intervals which signal is received by the receiving unit 18. The receiving unit 18 decodes the signals and provides outputs, such as flashing lights 20, a siren 21, or a signal 22 over a telephone line 23 to a monitoring station (not shown), which indicate the conditions detected.

Turning now to a more detailed description of the invention, the preferred embodiment of the detection system shown in FIG. 1 includes an intrusion detector unit 10, a panic button unit 11 and a fire detector unit 12. It is understood that the three remote units shown are exemplary. An embodiment may have two such remote units or it may have hundreds. Other types of detectors than intrusion, panic and fire may also be included. Remote unit 10 includes a magnetic contact device 31 on a door which is connected via wire 32 to a signal processing circuit 33. The processing circuit 33 is connected to r-f transmitter 14 which transmits a signal to receiving unit 18 via antenna 34. Similarly, panic unit 11 comprises a panic button 35 which is connected to signal processing circuit 36, which is connected to transmitter 15, having antenna 37, and fire unit 12 comprises fire detector 38 which is connected to signal processor 39, which is connected to transmitter 16, having antenna 40. Receiving unit 18 includes antenna 42 which is connected to a receiver and signal processing circuitry within its chassis 43. The signal processing circuitry is connected to annunciator lights 20, siren 21, and a telephone line 23. It is understood that the outputs 20, 21 and 23 are exemplary only. In some embodiments, only one such output may be used or a variety of others. It is also understood that a wide variety of other signals, such as battery status signals, supervision signals, etc. may be transmitted between sending units 10, 11 and 12 and receiving unit 18.

Figure 2:
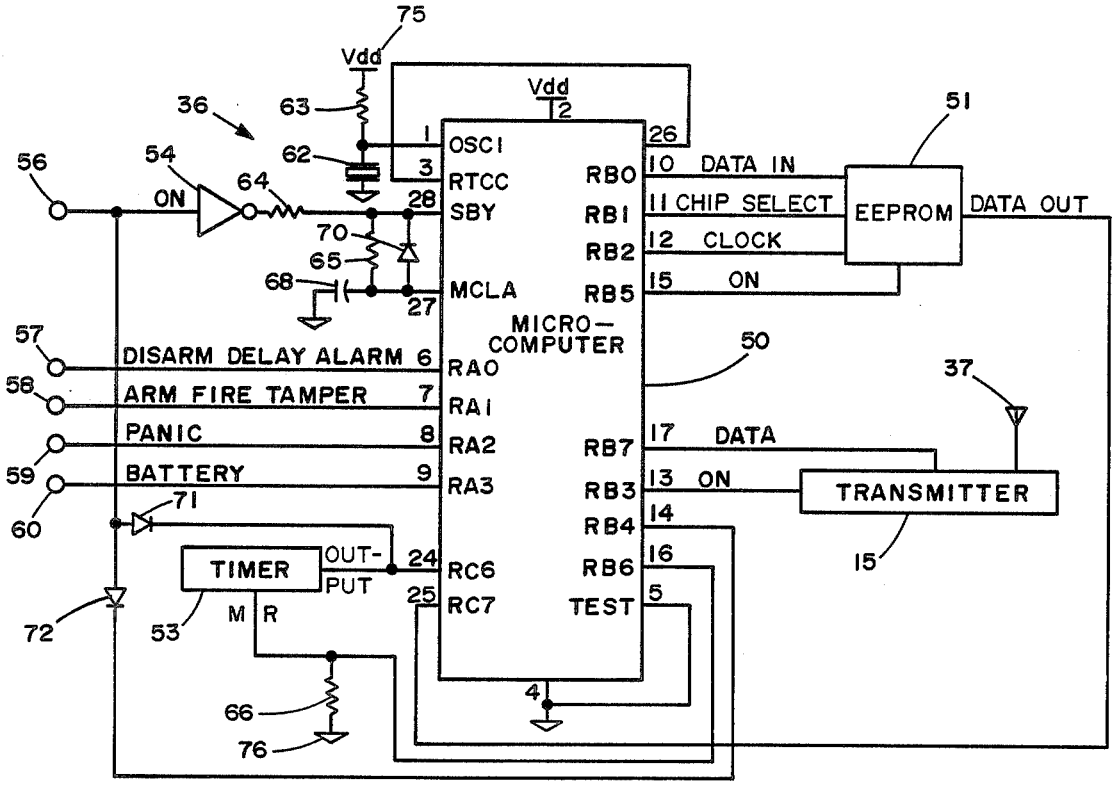
FIG. 2 is a detailed circuit diagram of an exemplary sending unit according to the invention.

A circuit diagram of a processing circuit, such as 36 of an exemplary sending unit, such as 11, is shown in FIG. 2. In this drawing, the numbers on the lines into the microcomputer 50, such as the "1" at the upper-left of the microcomputer 50, refer to the pin numbers of this component. The labels within the microcomputer next to the pins, such as "OSC1" next to pin 1, refer to the internal signals of the computing unit. The pin numbers and other details of the other components, such as EE Prom 51, transmitter 15, and timer 53 are not shown as details of such components are well known in the art.

The particular embodiment of the processing unit and transmitter shown in FIG. 2 is a multipurpose one to which a number of different sending devices, such as the panic button 35, fire detector 38, intrusion detector 31 or other devices may be connected. The sensing devices 31, 35 and 38 as well as the interface will not be described in detail as these are well known in the art. Any combination of sensing device and interface which upon triggering of the device places a low signal on line 56 for a time sufficient to activate microcomputer 50 and also on one of the input lines 57, 58 and 59 for a time sufficient to be read by microcomputer 50 may be used in this embodiment.

The processing circuit, such as 36, includes microcomputer 50, EE Prom 51, timer 53, inverter 54, ceramic resonator 62, resistors 63 through 66, capacitor 68 and diodes 70, 71 and 72. The processing circuit 36 also includes a power supply (not shown) which provides the voltage source required to use the circuitry, such as Vdd (75) and the ground, such as 76. Finally, the processor 36 also includes a battery status circuit (not shown) which provides a low signal on line 60 when the battery voltage drops below a certain level. The power supply and battery status circuits are known in the art and thus will not be described in detail herein.

The number 1 pin of microcomputer 50 is connected to ground through resonator 62 and the Vdd voltage through resistor 63. The number 2 pin is connected to the Vdd voltage. The number 3 pin is connected to the number 26 pin. The number 28 pin is connected to the output of inverter 54 through resistor 64. The input of inverter 54 is connected to input line 56. The number 28 pin is also connected to the number 27 pin through resistor 65 and diode 70 in parallel, with the cathode of the diode toward the number 28 pin. The number 27 pin is also connected to ground through capacitor 68. The number 6 through 9 pins are connected to inputs 57 through 60. The number 24 pin is connected to the output of timer 53. The output of timer 53 is also connected to the input of inverter 54 through diode 71, with the cathode of the diode toward the timer. The number 25 pin is connected to the data output of EE Prom 51. The number 4 and 6 pins are connected to the system ground. The number 16 pin of the microcomputer 50 is connected to the (MR) input of timer 53 and to ground through resistor 66. The number 14 pin is connected to the input of inverter 54 through diode 72 with the cathode of the diode toward the microcomputer. The number 13 pin is connected to the power on input of the transmitter 15 and the number 17 pin is connected to the data input of the transmitter. The number 15 pin is connected to the power on input to the EE Prom 51. Pins 10, 11 and 12 are connected to the data input, chip select, and clock inputs, respectively, of EE Prom 51.

In the preferred embodiment of the invention, the parts of the circuits of FIG. 2 are as follows: microcomputer 50 is a PIC 16C58, EE Prom 51 includes either an ER59256 or NMC9306N chip plus a FET and related circuitry as known in the art to power the chip. Transmitter 15 is preferably a transmitter as is described in U.S. patent application Ser. No. 06/765,280 plus associated buffers, transistors, etc. as known in the art to turn on and off the transmitter and to shape the data prior to transmitting it. Timer 53 includes a 4541 programmable timer and its associated components, inverter 54 is one of a Schmitt trigger hex inverter package type 40106 (the other inverters of the package are used in the sensing device interface in this embodiment), resonator 62 is a 2M hertz ceramic resonator, resistors 63, 64, 65 and 66 are 2.2M ohm, 4.7K ohm, 82K ohm and 100K ohm respectively, capacitor 68 is 0.1M farad, and diodes 70, 71 and 72 are type 1N4148. The electronic parts may be replaced by equivalent parts. In particular, transmitter 15 and receiver 18 may be any conventional transmitter/receiver pair, provided an appropriate data signal level is input to transmitter 15.

Figure 3:
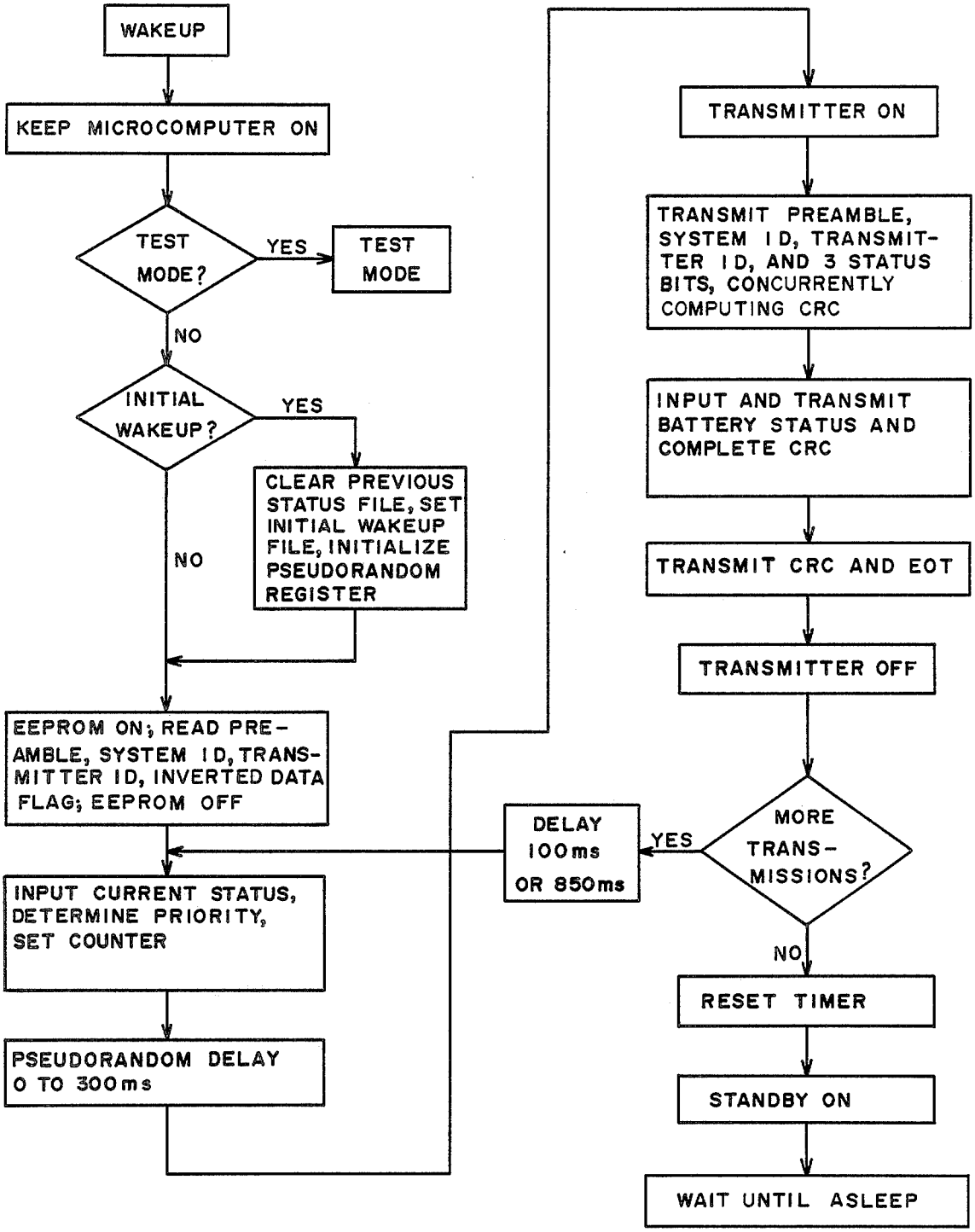
FIG. 3 is a flow chart showing the steps of the preferred embodiment of the microcomputer program according to the invention.

FIG. 3 shows a flow chart of the program according to the invention with which the microcomputer is programmed.

The invention functions as follows. Microcomputer 50 reads the condition signals input on the pins 6, 7, 8 and 9, encodes them, calculates a randomized time delay, waits for the calculated time, and then turns on the transmitter 15 by a signal on output pin 13, and modulates the transmitter 15 via a data signal output on pin 17 to send a signal representative of the condition to the receiving unit 18, which decodes the signal and provides an indication of the condition on annunciator 20, alarm 21, or telephone line 23.

Turning now to a more detailed discussion of the operation, to conserve battery power microcomputer 50 is normally held in stand-by by a low signal on pin 28. The timer 53, however, operates continuously as long as a battery with sufficient charge is connected to the system. The timer 53 is programmed to change its output (connected to pin 24 of the microcomputer 50) from high to low at appropriate times when it is desired to make a supervisory report. This low signal is applied to the input of inverter 54 which causes its output to go high, placing a high signal on pin 28 of microcomputer 50 to turn it on. Or, a low signal on the input 56 will also place a high signal on microcomputer input pin 28 to turn it on. A short time after pin 28 goes high, pin 27 also will go high (with a delay determined by resistor 65 and capacitor 68) and clears the microcomputer. Once turned on, the microcomputer drives its number 14 pin low to keep itself on. It then initializes the software, turns on the EE Prom by placing a high signal on pin 15, and enables the EE Prom 51 by placing a high signal on pin 11 (chip select), reads the sending unit identification data from EE Prom 51 on pin 25 while clocking the EE Prom with a signal output on pin 12 and sending the address from which the data is to be read via pin 10. The identification data consists of a preamble, system identification number, and transmitter identification number. The microcomputer 50 adds the current status (as defined by its input pins 6 through 8) to the identification data to complete a data signal to be transmitted. The microcomputer 50 then computes a 4-bit pseudo-random number (0 through 15) as follows: a 15-bit shift register is initialized with a non-zero value. The contents of the register are shifted left, with the right-most bit (bit 1) replaced by the exclusive-OR of bits 14 and 15 (the two left-most bits). This new number in the register is the pseudo-random number which is used to determine the number of 20 millisecond delay loops to be executed by the microcomputer. This randomized delay may be from 0 to 300 milliseconds (15×20 milliseconds) and will average 150 milliseconds. Each successive shift of the 15-bit register will generate a new 15-bit number in a pseudo-random sequence. The sequence repeats after 32,767 numbers have been generated. Only 4 bits from the 15-bit number are used to determine the randomized delay.

The microcomputer 50 waits through the number of loop time periods determined by the pseudo-random number, then applies a high signal on pin 13. This high signal turns on the transmitter 15 and battery level indicator circuit (not shown). The preamble, system identification number, transmitter identification number and status are then output on pin 17. The battery status is then read on line 9 (a low signal indicates a low battery) and transmitted while a polynominal for checking the data (the CRC) is calculated. The CRC and an end of transmission signal (EOT) are then transmitted and the transmitter is turned off. After a supervisory transmission (activated by timer 53), the microcomputer then resets the timer by a high signal on pin 16 and returns itself to stand-by. Non-supervisory transmissions, however, are repeated with a predetermined fixed delay plus a pseudo-random delay before the microcomputer resets the timer and returns to standby. If the condition to be reported is on pins 6 or 7, the transmission is repeated nine times with a 100 millisecond predetermined fixed delay plus the random delay. If the condition to be reported is on input 8 (the panic button input), the transmitter will typically be in a portable unit. Because the transmitter location is not fixed, the signal strength may be marginal, so the transmission is repeated thirty times with an 850 millisecond fixed delay plus the random delay. In the preferred embodiment, the transmitt4ed data word lasts 18 milliseconds. Supervisory transmission reporting is set to about 60 seconds by conventional RC tuning and programming of timer 53. The preferred computer program for determining the random delay and the CRC is provided at the end of the description just prior to the claims.

The EE prom may be programmed with the identification data in any conventional manner. In the preferred embodiment, a separate port is provided (not shown) which connects to the system ground, the Vdd line, and pins 25, 11, 12, 15 and 10 of microcomputer 50, and which shunts pin 28 of the microcomputer to ground. The ground (low) signal on pin 28 holds the microcomputer in standby and the connections to pins 25, 11, 12, 15 and 10 via the port may then

PROGRAM FOR CALCULATING THE PSEUDO-RANDOM NUMBER AND CRC IN THE TRANSMITTER

```
1.   0000   6000          MOVLW   000
2.   0001   0006          TRIS    006
3.   0002   6377          MOVLW   377
4.   0003   0007          TRIS    007
5.   0004   3707  OUTPUT  BTFSS   007,6
6.   0005   5004          GOTO    OUTPUT
7.   0006   5171          GOTO    START
8.   0007   3307  CHECK   BTFSC   007,6
9.   0010   5007          GOTO    CHECK
10.  0011   5004          GOTO    OUTPUT      ;TEST ONLY
11.  0012   0176  RESET   CLRF    036
12.  0013   6252          MOVLW   252
13.  0014   0050          MOVWF   010         initial pseudorandom
14.  0015   0051          MOVWF   011
15.  0016   0002          RETURN
16.  0017   0066  READ    MOVWF   026
17.  0020   2446          BSF     006,1
18.  0021   2506          BSF     006,2
19.  0022   2106          BCF     006,2
20.  0023   2406          BSF     006,0
21.  0024   2506          BSF     006,2
22.  0025   6010          MOVLW   010
23.  0026   0067          MOVWF   027
```

```
24.  0027  1566  NEXT     RLF      026,F
25.  0030  2106          BCF      006,2
26.  0031  2406          BSF      006,0
27.  0032  3403          BTFSS    003,0
28.  0033  2006          BCF      006,0
29.  0034  2506          BSF      006,2
30.  0035  1367          DECFSZ   027,F
31.  0036  5027          GOTO     NEXT
32.  0037  6020          MOVLW    020
33.  0040  0067          MOVWF    027
34.  0041  2106          BCF      006,2
35.  0042  2006          BCF      006,0
36.  0043  2506          BSF      006,2
37.  0044  2106  INPUT   BCF      006,2
38.  0045  1507          RLF      007,W
39.  0046  1555          RLF      015,F
40.  0047  1554          RLF      014,F
41.  0050  2506          BSF      006,2
42.  0051  1367          DECFSZ   027,F
43.  0052  5044          GOTO     INPUT
44.  0053  2106          BCF      006,2
45.  0054  2006          BCF      006,0
46.  0055  2046          BCF      006,1
47.  0056  0002          RETURN
48.  0057  1012  RAND16  MOVF     012,W
49.  0060  0055          MOVWF    015
50.  0061  1555          RLF      015,F
51.  0062  0615          XORWF    015,W
52.  0063  1555          RLF      015,F
53.  0064  1555          RLF      015,F     pseudorandom delay
54.  0065  0655          XORWF    015,F
55.  0066  1611          SWAPF    011,W
56.  0067  0655          XORWF    015,F
57.  0070  1551          RLF      011,F
58.  0071  1552          RLF      012,F
59.  0072  2411          BSF      011,0
60.  0073  3755          BTFSS    015,7
61.  0074  2011          BCF      011,0
62.  0075  1511          RLF      011,W
63.  0076  7036          ANDLW    036
64.  0077  3103          BTFSC    003,2
65.  0100  0002          RETURN
66.  0101  0057  WAIT    MOVWF    017
67.  0102  6005  WAIT1   MOVLW    005
68.  0103  0056          MOVWF    016
69.  0104  6204  WAIT2   MOVLW    204
70.  0105  0055          MOVWF    015
71.  0106  1355  WAIT3   DECFSZ   015,F
72.  0107  5106          GOTO     WAIT3
73.  0110  1356          DECFSZ   016,F
74.  0111  5104          GOTO     WAIT2
75.  0112  1357          DECFSZ   017,F
76.  0113  5102          GOTO     WAIT1
77.  0114  0002          RETURN
78.  0115  1566  DOUT    RLF      026,F
79.  0116  3003          BTFSC    003,0
80.  0117  5125          GOTO     POS
81.  0120  1535  NEG     RLF      035,W
82.  0121  3003          BTFSC    003,0
83.  0122  5130          GOTO     HOUT
```

| | | | | | | |
|---|---|---|---|---|---|---|
| 84. | 0123 | 2003 | LOUT | BCF | 003,0 | |
| 85. | 0124 | 0002 | | RETURN | | |
| 86. | 0125 | 1535 | POS | RLF | 035,W | |
| 87. | 0126 | 3003 | | BTFSC | 003,0 | |
| 88. | 0127 | 5123 | | GOTO | LOUT | |
| 89. | 0130 | 2403 | HOUT | BSF | 003,0 | |
| 90. | 0131 | 0002 | | RETURN | | |
| 91. | 0132 | 3003 | XWAIT1 | BTFSC | 003,0 | |
| 92. | 0133 | 5151 | | GOTO | PDAT | |
| 93. | 0134 | 5141 | | GOTO | NDAT | |
| 94. | 0135 | 3003 | XWAIT2 | BTFSC | 003,0 | |
| 95. | 0136 | 5147 | | GOTO | PWAIT2 | |
| 96. | 0137 | 3741 | NWAIT2 | BTFSS | 001,7 | |
| 97. | 0140 | 5137 | | GOTO | NWAIT2 | |
| 98. | 0141 | 2346 | NDAT | BCF | 006,7 | |
| 99. | 0142 | 6116 | | MOVLW | 116 | |
| 100. | 0143 | 0041 | | MOVWF | 001 | |
| 101. | 0144 | 0002 | | RETURN | | |
| 102. | 0145 | 3346 | COMP | BTFSC | 006,7 | |
| 103. | 0146 | 5137 | | GOTO | NWAIT2 | |
| 104. | 0147 | 3741 | PWAIT2 | BTFSS | 001,7 | |
| 105. | 0150 | 5147 | | GOTO | PWAIT2 | |
| 106. | 0151 | 2746 | PDAT | BSF | 006,7 | |
| 107. | 0152 | 6116 | | MOVLW | 116 | |
| 108. | 0153 | 0041 | | MOVWF | 001 | |
| 109. | 0154 | 0002 | | RETURN | | |
| 110. | 0155 | 1526 | CRC | RLF | 026,W | |
| 111. | 0156 | 1577 | | RLF | 037,F | |
| 112. | 0157 | 3677 | | BTFSS | 037,5 | |
| 113. | 0160 | 0002 | | RETURN | | CRC calculation |
| 114. | 0161 | 6005 | | MOVLW | 005 | |
| 115. | 0162 | 0677 | | XORWF | 037,F | |
| 116. | 0163 | 0002 | | RETURN | | |
| 117. | 0164 | 3741 | EOT | BTFSS | 001,7 | |
| 118. | 0165 | 5164 | | GOTO | EOT | |
| 119. | 0166 | 6116 | | MOVLW | 116 | |
| 120. | 0167 | 0041 | | MOVWF | 001 | |
| 121. | 0170 | 0002 | | RETURN | | |
| 122. | 0171 | 6000 | START | MOVLW | 000 | |
| 123. | 0172 | 0006 | | TRIS | 006 | |
| 124. | 0173 | 6377 | | MOVLW | 377 | |
| 125. | 0174 | 0007 | | TRIS | 007 | |
| 126. | 0175 | 2206 | | BCF | 006,4 | |
| 127. | 0176 | 3607 | | BTFSS | 007,4 | |
| 128. | 0177 | 5511 | | GOTO | TEST | |
| 129. | 0200 | 6252 | | MOVLW | 252 | |
| 130. | 0201 | 0210 | | SUBWF | 010,W | |
| 131. | 0202 | 3503 | | BTFSS | 003,2 | |
| 132. | 0203 | 4412 | | CALL | RESET | |
| 133. | 0204 | 2646 | | BSF | 006,5 | |
| 134. | 0205 | 6200 | | MOVLW | 200 | |
| 135. | 0206 | 4417 | | CALL | READ | |
| 136. | 0207 | 1014 | | MOVF | 014,W | |
| 137. | 0210 | 0072 | | MOVWF | 032 | |
| 138. | 0211 | 1015 | | MOVF | 015,W | |
| 139. | 0212 | 0073 | | MOVWF | 033 | |
| 140. | 0213 | 6201 | | MOVLW | 201 | |
| 141. | 0214 | 4417 | | CALL | READ | |
| 142. | 0215 | 1014 | | MOVF | 014,W | |
| 143. | 0216 | 0074 | | MOVWF | 034 | |

```
144.   0217   1015          MOVF    015,W
145.   0220   0075          MOVWF   035
146.   0221   2335          BCF     035,6
147.   0222   3247          BTFSC   007,5
148.   0223   2735          BSF     035,6
149.   0224   2246          BCF     006,5
150.   0225   6001          MOVLW   001
151.   0226   0065          MOVWF   025
152.   0227   2536          BSF     036,2
153.   0230   2476          BSF     036,1
154.   0231   3735          BTFSS   035,6
155.   0232   2436          BSF     036,0
156.   0233   0170          CLRF    030
157.   0234   1005   XMIT   MOVF    005,W
158.   0235   0071          MOVWF   031
159.   0236   3530   AGAIN  BTFSS   030,2
160.   0237   5251          GOTO    CURH
161.   0240   2030   ADDAD  BCF     030,0
162.   0241   2070          BCF     030,1
163.   0242   2436          BSF     036,0
164.   0243   2476          BSF     036,1
165.   0244   3431          BTFSS   031,0
166.   0245   2036          BCF     036,0
167.   0246   3471          BTFSS   031,1
168.   0247   2076          BCF     036,1
169.   0250   5321          GOTO    PSEUDO
170.   0251   3131   CURH   BTFSC   031,2
171.   0252   5260          GOTO    CHKA
172.   0253   2136          BCF     036,2
173.   0254   2530          BSF     030,2
174.   0255   6036          MOVLW   036
175.   0256   0065          MOVWF   025
176.   0257   5240          GOTO    ADDAD
177.   0260   3470   CHKA   BTFSS   030,1
178.   0261   5267          GOTO    CURA
179.   0262   2030   ADDD   BCF     030,0
180.   0263   2436          BSF     036,0
181.   0264   3431          BTFSS   031,0
182.   0265   2036          BCF     036,0
183.   0266   5321          GOTO    PSEUDO
184.   0267   3071   CURA   BTFSC   031,1
185.   0270   5276          GOTO    CHKD
186.   0271   2076          BCF     036,1
187.   0272   2470          BSF     030,1
188.   0273   6011          MOVLW   011
189.   0274   0065          MOVWF   025
190.   0275   5262          GOTO    ADDD
191.   0276   3030   CHKD   BTFSC   030,0
192.   0277   5321          GOTO    PSEUDO
193.   0300   3031          BTFSC   031,0
194.   0301   5311          GOTO    CHKC
195.   0302   3436          BTFSS   036,0
196.   0303   5321          GOTO    PSEUDO
197.   0304   2036          BCF     036,0
198.   0305   2430          BSF     030,0
199.   0306   6011          MOVLW   011
200.   0307   0065          MOVWF   025
201.   0310   5321          GOTO    PSEUDO
202.   0311   3735   CHKC   BTFSS   035,6
203.   0312   5321          GOTO    PSEUDO
```

```
204.  0313  3036          BTFSC   036,0
205.  0314  5321          GOTO    PSEUDO
206.  0315  2436          BSF     036,0
207.  0316  2430          BSF     030,0
208.  0317  6011          MOVLW   011
209.  0320  0065          MOVWF   025
210.  0321  4457  PSEUDO  CALL    RAND16 <-- pseudorandom delay
211.  0322  2546          BSF     006,3
212.  0323  1032          MOVF    032,W
213.  0324  0066          MOVWF   026
214.  0325  6007          MOVLW   007
215.  0326  0067          MOVWF   027
216.  0327  4515          CALL    DOUT
217.  0330  4532          CALL    XWAIT1
218.  0331  4515  PRE1    CALL    DOUT
219.  0332  4535          CALL    XWAIT2
220.  0333  1367          DECFSZ  027,F
221.  0334  5331          GOTO    PRE1
222.  0335  1033          MOVF    033,W
223.  0336  0066          MOVWF   026
224.  0337  6010          MOVLW   010
225.  0340  0067          MOVWF   027
226.  0341  4515  PRE2    CALL    DOUT
227.  0342  4535          CALL    XWAIT2
228.  0343  1367          DECFSZ  027,F
229.  0344  5341          GOTO    PRE2
230.  0345  0177          CLRF    037
231.  0346  1034          MOVF    034,W
232.  0347  0066          MOVWF   026
233.  0350  6010          MOVLW   010
234.  0351  0067          MOVWF   027
235.  0352  4555  SYSTEM  CALL    CRC
236.  0353  4515          CALL    DOUT
237.  0354  4535          CALL    XWAIT2
238.  0355  4545          CALL    COMP
239.  0356  1367          DECFSZ  027,F
240.  0357  5352          GOTO    SYSTEM
241.  0360  1035          MOVF    035,W
242.  0361  0066          MOVWF   026
243.  0362  1566          RLF     026,F
244.  0363  1566          RLF     026,F
245.  0364  6006          MOVLW   006
246.  0365  0067          MOVWF   027
247.  0366  4555  XMITTR  CALL    CRC
248.  0367  4515          CALL    DOUT
249.  0370  4535          CALL    XWAIT2
250.  0371  4545          CALL    COMP
251.  0372  1367          DECFSZ  027,F
252.  0373  5366          GOTO    XMITTR     calculation of CRC
253.  0374  1036          MOVF    036,W
254.  0375  0066          MOVWF   026
255.  0376  1666          SWAPF   026,F
256.  0377  1566          RLF     026,F
257.  0400  6003          MOVLW   003
258.  0401  0067          MOVWF   027
259.  0402  4555  STATUS  CALL    CRC
260.  0403  4515          CALL    DOUT
261.  0404  4535          CALL    XWAIT2
262.  0405  4545          CALL    COMP
263.  0406  1367          DECFSZ  027,F
```

```
264.   0407   5402          GOTO     STATUS
265.   0410   1005          MOVF     005,W
266.   0411   7010          ANDLW    010
267.   0412   6000          MOVLW    000
268.   0413   3503          BTFSS    003,2
269.   0414   6200          MOVLW    200
270.   0415   0066          MOVWF    026
271.   0416   4555          CALL     CRC
272.   0417   4515          CALL     DOUT
273.   0310   4535          CALL     XWAIT2
274.   0421   4545          CALL     COMP
275.   0422   6037          MOVLW    037
276.   0423   0577          ANDWF    037,F
277.   0424   1037          MOVF     037,W
278.   0425   0066          MOVWF    026
279.   0426   1566          RLF      026,F
280.   0427   1566          RLF      026,F
281.   0430   1566          RLF      026,F
282.   0431   6005          MOVLW    005
283.   0432   0067          MOVWF    027
284.   0433   4515   CRCS   CALL     DOUT
285.   0434   4535          CALL     XWAIT2
286.   0435   4545          CALL     COMP
287.   0436   1367          DECFSZ   027,F
288.   0437   5433          GOTO     CRCS
289.   0440   4545          CALL     COMP
290.   0441   4564          CALL     EOT
291.   0442   4564          CALL     EOT
292.   0443   4564          CALL     EOT
293.   0444   4564          CALL     EOT
294.   0445   2346          BCF      006,7
295.   0446   2146          BCF      006,3
296.   0447   1365          DECFSZ   025,F
297.   0450   5472          GOTO     DELAY
298.   0451   3735          BTFSS    035,6
299.   0452   5503          GOTO     EXIT
300.   0453   3430          BTFSS    030,0
301.   0454   5503          GOTO     EXIT
302.   0455   1005          MOVF     005,W
303.   0456   0071          MOVWF    031
304.   0457   2536          BSF      036,2
305.   0460   2476          BSF      036,1
306.   0461   0170          CLRF     030
307.   0462   3036          BTFSC    036,0
308.   0463   5467          GOTO     PCHG
309.   0464   3031          BTFSC    031,0
310.   0465   5236          GOTO     AGAIN
311.   0466   5503          GOTO     EXIT
312.   0467   3431   PCHG   BTFSS    031,0
313.   0470   5236          GOTO     AGAIN
314.   0471   5503          GOTO     EXIT
315.   0472   6012   DELAY  MOVLW    012
316.   0473   0056          MOVWF    016
317.   0474   3530          BTFSS    030,2
318.   0475   5500          GOTO     SPACE
319.   0476   6125          MOVLW    125
320.   0477   0056          MOVWF    016
321.   0500   1016   SPACE  MOVF     016,W
322.   0501   4501          CALL     WAIT
323.   0502   5234          GOTO     XMIT
```

```
0503  2706  EXIT   BSF     006,6
0504  2306         BCF     006,6
0505  2606         BSF     006,4
0506  5007         GOTO    CHECK      ; TEST ONLY
0507  0000  SLEEP  NOP
0510  5507         GOTO    SLEEP
0511  6125  TEST   MOVLW   125
0512  0077         MOVWF   037
0513  0000         NOP
0514  0277         SUBWF   037,F
0515  3503         BTFSS   003,2
0516  5606         GOTO    ERROR
0517  6036         MOVLW   036
0520  0077         MOVWF   037
0521  1037  CB1    MOVF    037,W
0522  0044         MOVWF   004
0523  6125         MOVLW   125
0524  0040         MOVWF   000
0525  0000         NOP
0526  0240         SUBWF   000,F
0527  3503         BTFSS   003,2
0530  5606         GOTO    ERROR
0531  0377         DECF    037,F
0532  6007         MOVLW   007
0533  0237         SUBWF   037,W
0534  3503         BTFSS   003,2
0535  5521         GOTO    CB1
0536  6252         MOVLW   252
0537  0077         MOVWF   037
0540  0000         NOP
0541  0277         SUBWF   037,F
0542  3503         BTFSS   003,2
0543  5606         GOTO    ERROR
0544  6036         MOVLW   036
0545  0077         MOVWF   037
0546  1037  CB2    MOVF    037,W
0547  0044         MOVWF   004
0550  6125         MOVLW   125
0551  0040         MOVWF   000
0552  0000         NOP
0553  0240         SUBWF   000,F
0554  3503         BTFSS   003,2
0555  5606         GOTO    ERROR
0556  0377         DECF    037,F
0557  6007         MOVLW   007
0560  0237         SUBWF   037,W
0561  3503         BTFSS   003,2
0562  5546         GOTO    CB2
0563  2546         BSF     006,3
0564  2346  TLOW   BCF     006,7
0565  1005         MOVF    005,W
0566  7016         ANDLW   016
0567  3503         BTFSS   003,2
0570  5574         GOTO    THIGH
0571  3607         BTFSS   007,4
0572  5564         GOTO    TLOW
0573  5603         GOTO    TEXIT
0574  2746  THIGH  BSF     006,7
0575  1005         MOVF    005,W
0576  7016         ANDLW   016
```

```
384.   0577   3103          BTFSC   003,2
385.   0600   5564          GOTO    TLOW
386.   0601   3607          BTFSS   007,4
387.   0602   5574          GOTO    THIGH
388.   0603   2346   TEXIT  BCF     006,7
389.   0604   2146          BCF     006,3
390    0605   5503          GOTO    EXIT
391.   0606   2346   ERROR  BCF     006,7
392.   0607   2546          BSF     006,3
393.   0610   6031          MOVLW   031
394.   0611   4501          CALL    WAIT
395.   0612   2146          BCF     006,3
396.   0613   6031          MOVLW   031
397.   0614   4501          CALL    WAIT
398.   0615   3607          BTFSS   007,4
399.   0616   5606          GOTO    ERROR
400.   0617   5603          GOTO    TEXIT
401.   0761                 ORG     761
402.   0761   0102          DATA    102
403.   0762   0122          DATA    122
404.   0763   0111          DATA    111
405.   0764   0101          DATA    101
406.   0765   0116          DATA    116
407.   0766   0040          DATA    040
408.   0767   0104          DATA    104
409.   0770   0040          DATA    040
410.   0771   0104          DATA    104
411.   0772   0101          DATA    101
412.   0773   0127          DATA    127
413.   0774   0123          DATA    123
414.   0775   0117          DATA    117
415.   0776   0116          DATA    116
416.   0777   5171          GOTO    START
417.                        END
```

What is claimed is:

1. A detection system comprising:

a plurality of sending units, each of said units comprising:

sensing means for sensing a condition;

means for generating a pseudo-random number;

means responsive to said sensing means and said means for generating for sending a data signal representative of said condition at pseudo-randomized time intervals, said means including a means for cycling through a number of timing loops in a microprocessor program equal to said pseudo-random number before outputting said data, and a means for delaying the sending of said data signal for a predetermined time interval in addition to the pseudo-random time interval; and receiving means for receiving said data signals and producing an output indicative of said condition.

2. A method of providing an indication of a condition at a remote location comprising:

sensing said condition;

generating a pseudo-random number;

cycling through a timing loop in a microprocessor program a number of times equal to said pseudo-random number;

waiting for a predetermined time interval;

sending a data signal representative of said condition; and receiving said data signal and utilizing it to provide an indication of said condition.

* * * * *